United States Patent [19]
Giulini
[11] 4,318,236
[45] Mar. 9, 1982

[54] HOLDER HAVING MOVEABLE INDEXES

[76] Inventor: Luciano Giulini, Via Cenisio, 10/A, Milan, Italy

[21] Appl. No.: 38,266

[22] Filed: May 11, 1979

[30] Foreign Application Priority Data

May 19, 1978 [IT] Italy ..... 23600 A/78

[51] Int. Cl.[3] ..... B42F 21/00
[52] U.S. Cl. ..... 40/360; 40/23 A
[58] Field of Search ..... 40/359, 360, 23 A, 16.5

[56] References Cited

U.S. PATENT DOCUMENTS

| | | | |
|---|---|---|---|
| 1,936,558 | 11/1933 | Meyers | 40/360 |
| 2,122,223 | 6/1938 | Von Dollen | 40/360 |
| 2,603,219 | 7/1952 | Jones | 40/359 |
| 2,679,846 | 6/1954 | Addison | 40/360 |
| 4,186,505 | 2/1980 | Brandel | 40/360 |

FOREIGN PATENT DOCUMENTS

| | | | |
|---|---|---|---|
| 2404860 | 1/1974 | Fed. Rep. of Germany | 40/16.6 |
| 414548 | 12/1966 | Switzerland | 49/359 |

*Primary Examiner*—Gene Mancene
*Assistant Examiner*—Wenceslao J. Contreras
*Attorney, Agent, or Firm*—Browdy and Neimark

[57] ABSTRACT

A holder for document holding packets, board or the like provided with mobile indexes for scheduling, checking of due dates, statistical data and similar material which includes a band-like element sub-divided into a bottom strip portion for supporting the document holding packet and a top strip portion, slightly inclined to the bottom strip portion and provided with a first elongated guide having markers slidable therewithin, and a second elongated guide with a slidable cursor therein, this guide having an internal groove extending along its length and a plate which fits into the internal groove to allow the plate to be fixed along the internal groove.

7 Claims, 4 Drawing Figures

HOLDER HAVING MOVEABLE INDEXES

BACKGROUND OF THE INVENTION

1. Field of the Invention

This invention relates to a holder for document holding-pockets and the like with mobile indexes for scheduling, checking of due dates, statistical data and similar material of the kind which includes a band-like element sub-divided into a bottom strip which supports a document holding case and an upper strip, slightly inclined with respect to the bottom strip. The strip may support a graduated bottom scale, a number of little markers which are made to slide in a first elongated guide and a cursor which slides in a second elongated guide which is below and parallel to the aforementioned first guide. This holder for document-holding pockets may be applied especially in the field of data relating for instance to a work schedule, because it makes it possible to plan, schedule and check the above data.

2. Prior Art

Traditional card indexes are conventionally made up of two parts: a pocket in which a number of documents is fitted and a band-like unit designed to support the pocket itself within a container. This band-like component may be made up of one single strip with markers moving in a vertical direction, or else of two parallel superimposed strips, slightly inclined in respect of one another, the markers moving horizontally. With special reference to the latter type, while the bottom strip, together with the document-holding pocket, is introduced into the container, the upper strip protrudes from the container itself in order to visualize a certain number of data pertaining to a schedule (relative to work, or dates of arrival or shipments of goods, etc.). This visualization is made possible because a graduated bottom scale is fitted into the strip itself, is made of transparent material, and additionally to a number of markers which are fitted into a slide provided in the upper strip which operate in conjunction with a cursor placed underneath, which is made to slide in another guide provided in that same upper part of the band-like unit. Due to the limited height of the upper strip protruding from the container, it is possible to obtain only one type of scheduling which is the one relative to due dates or other data. In fact, in conventional holders, can operate only along two lines. This upper line represents, for example, the schedule of due dates and is marked by the positioning of the markers which fulfil a certain function in relation to some date which is visible on the bottom-scale. The bottom line is marked by a cursor which represents the progressive working out of the functions indicated in the upper line and may be employed at most as an independent function relating to engagements, assignment work orders or the like. The main drawback encountered in current holders for document-holding pockets is represented by the limited and inflexible number of functions and situations which may be visualized, which allows the realization of a real and proper tickler. This operational and functional inelasticity causes a further drawback. In fact the documents remain in the pockets of the card index until they are cleared. At this stage they are passed on the other traditional files for cleared documents, but no indication is left in respect of their previous permanence in the pocket of the card index.

SUMMARY OF THE INVENTION

The object of this invention is to realize and make available a holder for document-holding pockets and the like which makes it possible to increase and diversify the number of indexed information on the holder. For example, the holder can increase the number of programmable functions indexed furthermore supplying some indication pertaining to emergency situations or in any case not defined initially, and to accomplish a true and proper scheduling as well as the execution of statistical surveys over some length of time, by using the bottom part of the band-shaped unit in order to visualize further sets of data capable of supplying a history of previous documents which have been through the pockets of the card index. The problem underlying the invention under discussion, namely that of assuring that all data can be changed, accumulated and be readable, is solved by a holder for document-holding pockets with mobile indexes for the scheduling, the check of due dates, statistical data and similar material, according to the invention which is characterized by the fact that the aforementioned second slide is provided internally with a groove in order to allow the interchange of the cursor with a pre-etched little plate, of various colours, and which presents a reducible surface on which one may write. To good advantage there has been produced in the lower strip a double slide which is parallel to the previous ones for the insertion of a number of further markers which are arranged to operate with three lines for the execution of statistical work and similar operation.

To good advantage and in accordance with another characteristic of the invention the aforementioned elongated first guide has its top and bottom sides slightly arched for the application thereof of U markers.

The advantages derived from a holder for document-holding pockets according to the invention are of considerable importance.

First of all it is to be noted that in the top part of the holder it is possible to work along three parallel or superimposed lines instead of two, a fact which allows the broadening of the field of use of the holder thus allowing the insertion of the U markers, which may be applied and removed with ease and make it possible to represent emergency situations or in any case situations awaiting definition and still at an hypothetical stage. Secondly, the possible interchangeability between the traditional cursor and the pre-etched little plate endowed with a writing surface, and equipped with an advancing cursor for the job card survey of previously scheduled situations, introduces a further working line thus permitting the visualization of all those operations which, by other means, are heretofor carried out on planning and statistical panels. Finally, another advantage which is in no way of little importance is provided by the complete utilization of the lower part of the band-shaped unit which allows the visualization of the history of the documents which gradually passed through the pockets of the card index.

BRIEF DESCRIPTION OF THE DRAWING

Some further features and advantages shall appear more clearly through the detailed description of an example of preferred embodiments but in no way an exclusive ones of a holder for document-holding pockets according to the invention; hereinafter reported with reference to the accompaying drawings, which are illustrative of, preferred embodiments given as non-limiting examples, where.

DESCRIPTION OF THE PREFERRED EMBODIMENTS

Figure 1:
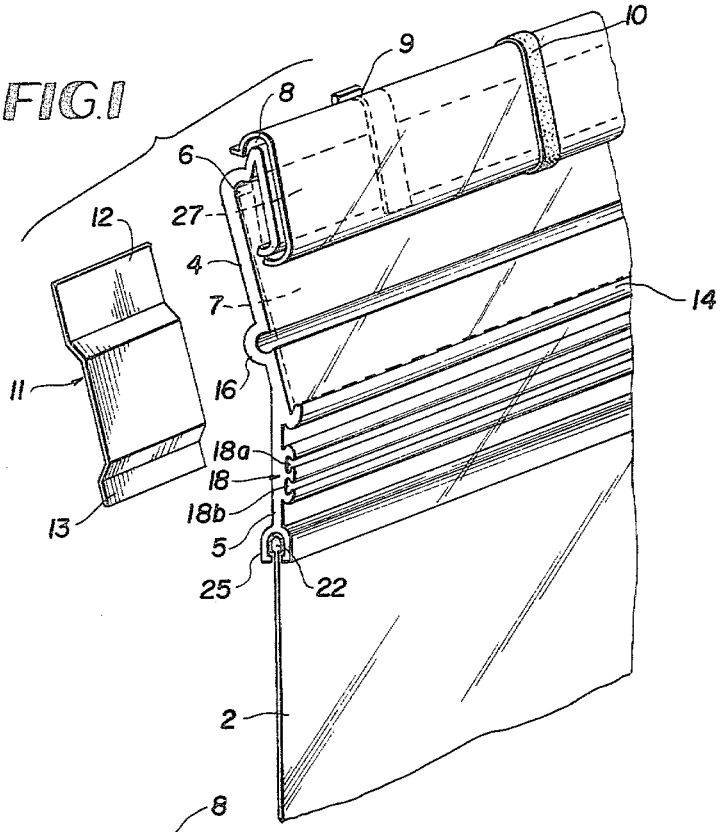
FIG. 1 is a perspective view of the principal components of the support for document-holding pockets according to the invention.
Figure 3:
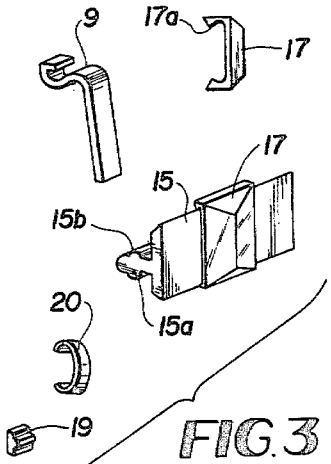
FIG. 3 is a perspective view of the marking elements which are engaged in the band-shaped support of FIG. 1.
Figure 2:
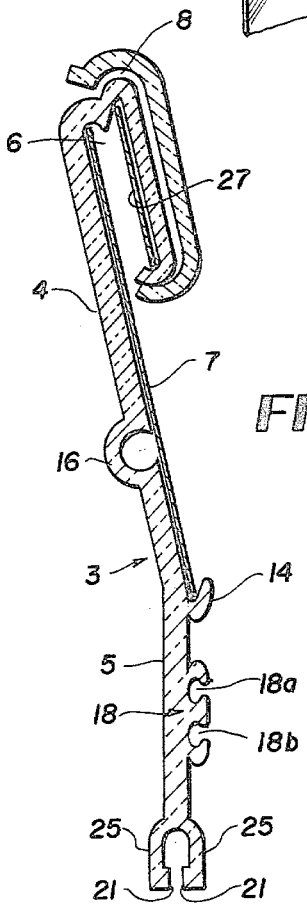
FIG. 2 is a vertical cross-section of the strip-shaped support of FIG. 1.

With reference to the above drawing, a support figures, for document-holding pockets which carries an extractable pocket 2, designed to contain a certain number of documents, made up of a panel sub-divided into an upper strip 4 and a lower strip 5. The band-shaped element is made of transparent material and presents, at the height of the upper strip 4, a double bend which defines a seat 6 for the housing of two graded bottom-scales and an elongated guide 8 in which a number of indexes is made to slide, such as markers 9 for instance, each of which represents a certain function. These markers 9 may to be placed according to the graduation of the scale which represents the time spar (minutes, hours, days, weeks, months) where each of the functions represented by markers 9 must be fulfilled.

The outside wall of the elongated guide 8 has its top and bottom sides slightly arched in order to allow the application of one or more U markers 10 which may for example, represent emergency or still undefined situations. A cursor 11 which may indicate for example, the job card in progress or an index of the total engagement undertaken is provided; a following index of a different colour for the farthest limit is also provided. The cursor 11 exhibits a flat top portion 12 which is made to slide within seat 6 of bottom scale 7 as well as a bottom tongue 13 which is kept upright by a serration 14 which extends covering the whole length of the panel 3. The serration 14 is also the dividing line between the top strip 4 and the bottom strip 5. When necessary the cursor 11 may be extracted and replaced by a preetched multiple plate 15, which presents a writing surface and which may be reduced to suitable size, and provided in its rear part with a rib 15*a* set at 90°, designed to fit into groove 16 produced in the top strip 4. In order to obtain a better fastening, rib 15*a* 15*b* for the pressure fitting between the walls of a limiting groove 16 in the upper strip 4. Plate 15 is also a slide bar for a knurled cursor 17 equipped with a pair of tongues 17*a* at the sides, suitable for being hooked to the edges of plate 15, the cursor 17 acting, for instance, as an index of job card in progress. In bottom strip 5 there has been produced a double slide 18 in the shape of a double superimposed 'C', composed of slides 18*a* and 18*b*, which are parallel to slide 8 and to groove 16. A number of further markers 19 is housed in each of the slides 18*a* and 18*b*. The top and bottom sides of the double slide 18 are slightly arched in order to prevent on the one hand the ejection of markers 19 and to allow on the other hand the insertion of one or more overmarkers 20 which may be applied in a 'U' fashion. In the end part of bottom strip 5 two tongues 25 are provided, which are slightly arched, internally equipped with an undercut 21. Once it is suitably prearranged, the top part of pocket 2 is fitted between the two tongues. The undercuts 21 cooperate with the thick part 22 of the extractable pocket 2 in order to prevent them from becoming disconnected from the support 1 downwardly, It is to be noted that the extractable pocket 2 may be provided with a number of compartments, in the front or in the back, and with various clamping elements, which have not been shown since they are known and have been conventionally adopted.

Figure 4:
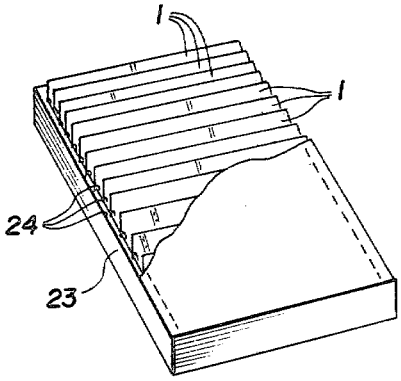
FIG. 4 is a perspective view of the band-shaped support according to a further embodiment of the invention.

With special reference to FIG. 4 and in accordance with a further embodiment, the panel may be utilized without the extractable pocket 2. Such application requires the employment of an horizontal rake-shaped panel 23, made up for instance of a metal plate or by suitably cut plastic supports. It is thus possible to realize an horizontal panel for the arrangement of programming statistical boards the production cost of which is definitely reduced in respect of those boards, which may be luminous or magnetic panels adapted in order to fulfil the same functions, the components resting on special notches 24 which are well-known. Of course, besides the above mentioned embodiments, it is possible to introduce several variations in respect of the card index under discussion, without leaving, for this reason, the protection sphere of the invention.

I claim:

1. In a holder for document holding pockets, boards or the like which is provided with a number of indexes and includes a panel unit divided into a bottom strip portion for supporting the document holding pocket, board or the like and a top strip portion, slightly inclined with respect to the bottom strip portion, the top strip portion being provided with a first elongated guide, a number of markers which are slidable within the first elongated guide, a second elongated guide underlying and parallel to the first elongated guide and a slidable cursor in the second elongated guide, an improvement comprising an internal groove extending within said second elongated guide along its length; and a plate having an extension which is complemental to and fits within said internal groove to allow said plate to be fixed along said internal groove, said plate having a surface facing outward from said second elongated guide on which it is possible to write, and said slidable cursor and said plate being removably positioned in said second elongated guide whereby one can replace the other.

2. An improved holder according to claim 1, wherein said bottom strip portion has a double guide extending over the complete length of said panel unit and substantially parallel to said first elongated guide and said second elongated guide, said double guide having two superimposed C-shaped channels, in each of them a number of further markers are slidably positioned, whereby at least three information lines are provided in the holder.

3. An improved holder according to claim 1 or claim 2, wherein said first elongated guide has its top and bottom edges slightly arched, and at least one U-shaped marker moveably positioned on said edges.

4. An improved holder according to claim 1 or claim 2, wherein said extension of said plate is a central rib which extends for the complete length of said plate and is insertable in said internal groove by force.

5. An improved holder according to claim 4, wherein said plate is a slide bar, and including a U-shape cursor slidably positioned over said slide bar.

6. An improved holder according to claim 1 or claim 2, wherein said plate is a slide bar, and including a U-shaped cursor slidably positioned over said slide bar.

7. An improved holder according to claim 2, wherein said two superimposed C-shaped channels are formed from three projecting ribs, the side ones of which form a further guide for a number of slidable U-shaped over-markers, the latter ones sliding above said number of further markers.

* * * * *